US006364308B1

(12) United States Patent
Tranquilla

(10) Patent No.: US 6,364,308 B1
(45) Date of Patent: Apr. 2, 2002

(54) DOCUMENT FEEDER WITH OVERLAP PREVENTION

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/459,556

(22) Filed: Dec. 13, 1999

(51) Int. Cl.[7] ..... B65H 3/46

(52) U.S. Cl. ..... 271/37; 271/10.11; 271/271; 271/110; 271/111; 271/122; 271/125

(58) Field of Search ..... 271/10.11, 37, 271/38, 110, 111, 122, 125

(56) References Cited

U.S. PATENT DOCUMENTS 2,813,717 A * 11/1957 Mentzer ..... 271/37
4,030,722 A * 6/1977 Irvine et al. ..... 271/111
4,436,298 A * 3/1984 Donner et al. ..... 271/111
5,397,107 A * 3/1995 Wolog et al. ..... 271/110
5,924,686 A * 7/1999 Jacobsen et al. ..... 271/110
5,996,988 A * 12/1999 Helmstadter et al. ..... 271/110

* cited by examiner

*Primary Examiner*—Christopher P. Ellis
*Assistant Examiner*—Mark A. Deuble
(74) *Attorney, Agent, or Firm*—Harness Dickey & Pierce; Mark T. Starr

(57) ABSTRACT

A document feeder with overlap protection that prevents the overlap of successive documents moving from a document stack and that utilizes a nudger. An independent motor selectively drives the nudger. Document edge detectors sense the location of documents at the nudger and at other locations fed from the document stack and send control signals to the independent motor so that a proper distance is maintained between successive documents. A document edge detector can be placed at various locations along the path of document travel.

9 Claims, 3 Drawing Sheets

DOCUMENT FEEDER WITH OVERLAP PREVENTION

BACKGROUND OF THE INVENTION

The present invention is to provide the art with an electromechanical system for preventing the overlap of documents fed from a stack.

A variety of automated machines such as document sorters, mail sorters, copiers, page feeders, punch card readers, automatic teller machines and fax machines utilize document feeders to move documents within a machine. Documents in a machine are often stacked and automatically fed from the stack. In the process of successively feeding documents from the stack, the documents may undesirably overlap. The overlap of documents may cause a misfeed or jam in a machine and interrupt the successful processing of documents.

SUMMARY OF THE INVENTION

An object of the present invention is to provide a document feeder with protection against overlap of documents during processing in automated machines. More particularly, the present invention is directed to an independently driven nudger for controlling document movement.

In accordance with the teachings of the present invention a document feeder with overlap protection is disclosed. A nudger is positioned to rest on a first document of a document stack located in a hopper. The nudger maintains a proper space between a first document and a next document. An edge detector located at the nudger indicates whether the nudger should be rotating. A feed wheel accelerates the first document and a separator retains the next document in the hopper.

BRIEF DESCRIPTION OF THE DRAWINGS

The accompanying drawings that are incorporated in and constitute part of the specification illustrate embodiments of the present invention and together with the description serve to explain the principles of the invention.

DETAILED DESCRIPTION OF THE PREFERRED EMBODIMENTS

Figure 1:
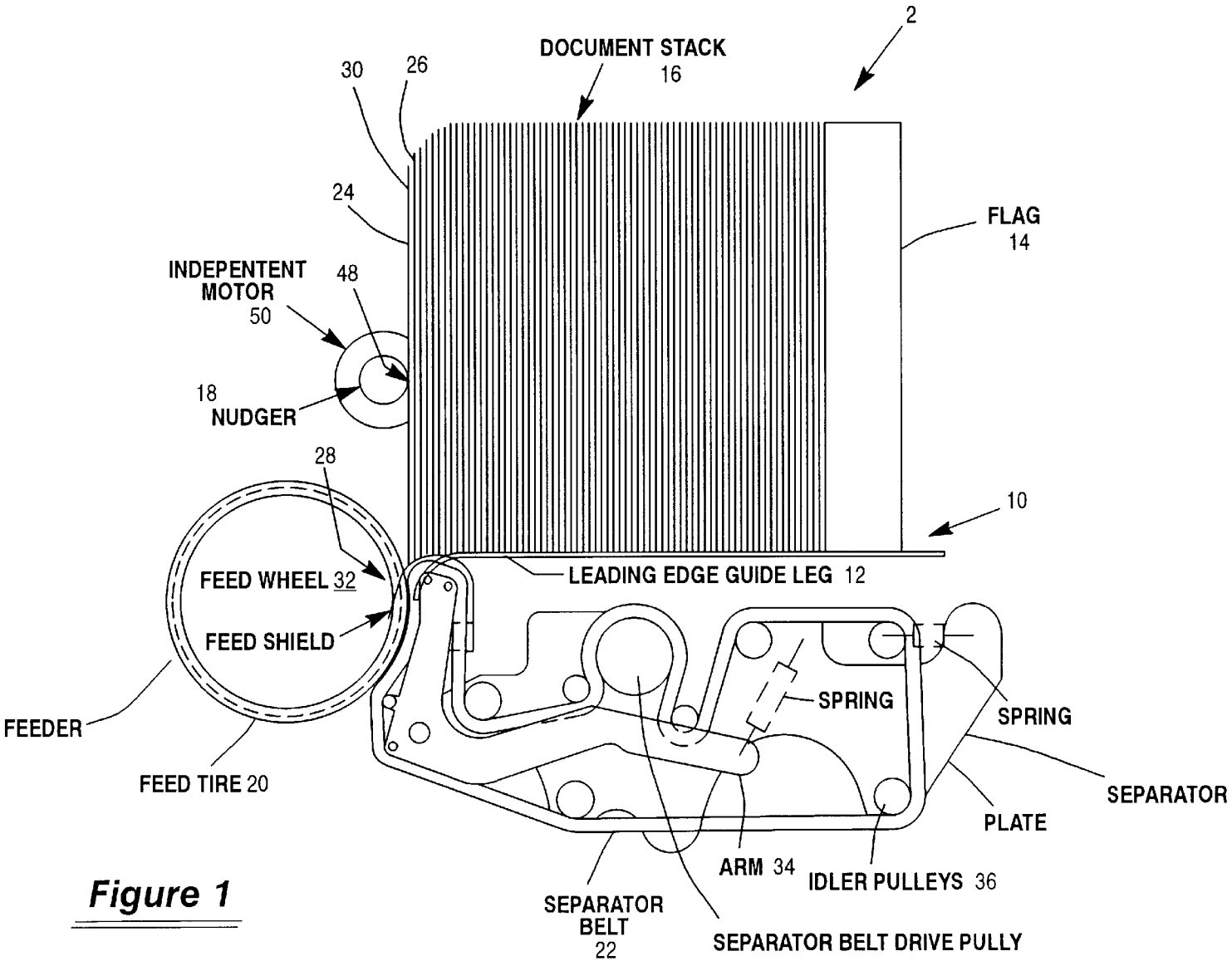
FIG. 1 is a perspective view showing a preferred embodiment of document feeder with overlap protection according to the present invention.

FIG. 1 shows a document feeder 2 with overlap protection. Document stack hopper 10 has a document leading edge guide wall 12 to support the documents, and moveable flag 14 to apply a force to one end of document stack 16. A reaction force develops at the other end of document stack 16 where nudger 18, feed tire 20, and separator 22 contact document stack 16, consequently, a friction force develops between first document 24 being fed and next document 26. Nudger 18, feeder tire 20 and separator 22 are rotating as flag 14 pushes document stack 16 along leading edge guide 12, toward nudger 18.

Nudger 18, feed tire 20, and separator 22 control movement of first document 24 through the feeder/separator nip 28. Nudger 18 and feed tire 20 accelerate first document 24. Nudger 18 moves first document 24 a distance from the leading edge guide 12 to the feeder/separator nip 28 formed by feed tire 20 and separator 22. Feed tire 20 drags first document 24 through feeder/separator nip 28 because the friction between feed tire 20 and first document 24 is greater than the friction between first document 24 and next document 26. Separator 22 separates next document 26 from first document 24 because the friction between separator 22 and next document 26 is greater that the friction between first document 24 and next document 26. First document 24 feeds because the friction among feed tire 20, nudger 18 and first document 24 is greater than friction between separator 22 and next document 26. Feed tire 20 and nudger 18 feed first document 24 while separator 22 impedes movement of next document 26.

In the preferred embodiment, feed tire 20 moves along feed wheel 32. Separator 22 is supported by arm 34, idler pulleys 36, and separator belt drive pulley 38. Separator 22 is preferably a belt and may rotate clockwise or counterclockwise. Each of nudger 18, feed wheel 42, and separator 22 is driven by independent motor 20, thereby applying variable forces to a document.

Nudger 18 is independently driven by a motor drive preferably a DC servomotor with appropriate feedback controls, a stepper motor, or fast accelerating/decelerating motor. A clutch/brake may also vary the acceleration of nudger 18. Separator belt 22 holds back documents intended not to be fed.

Figure 3:
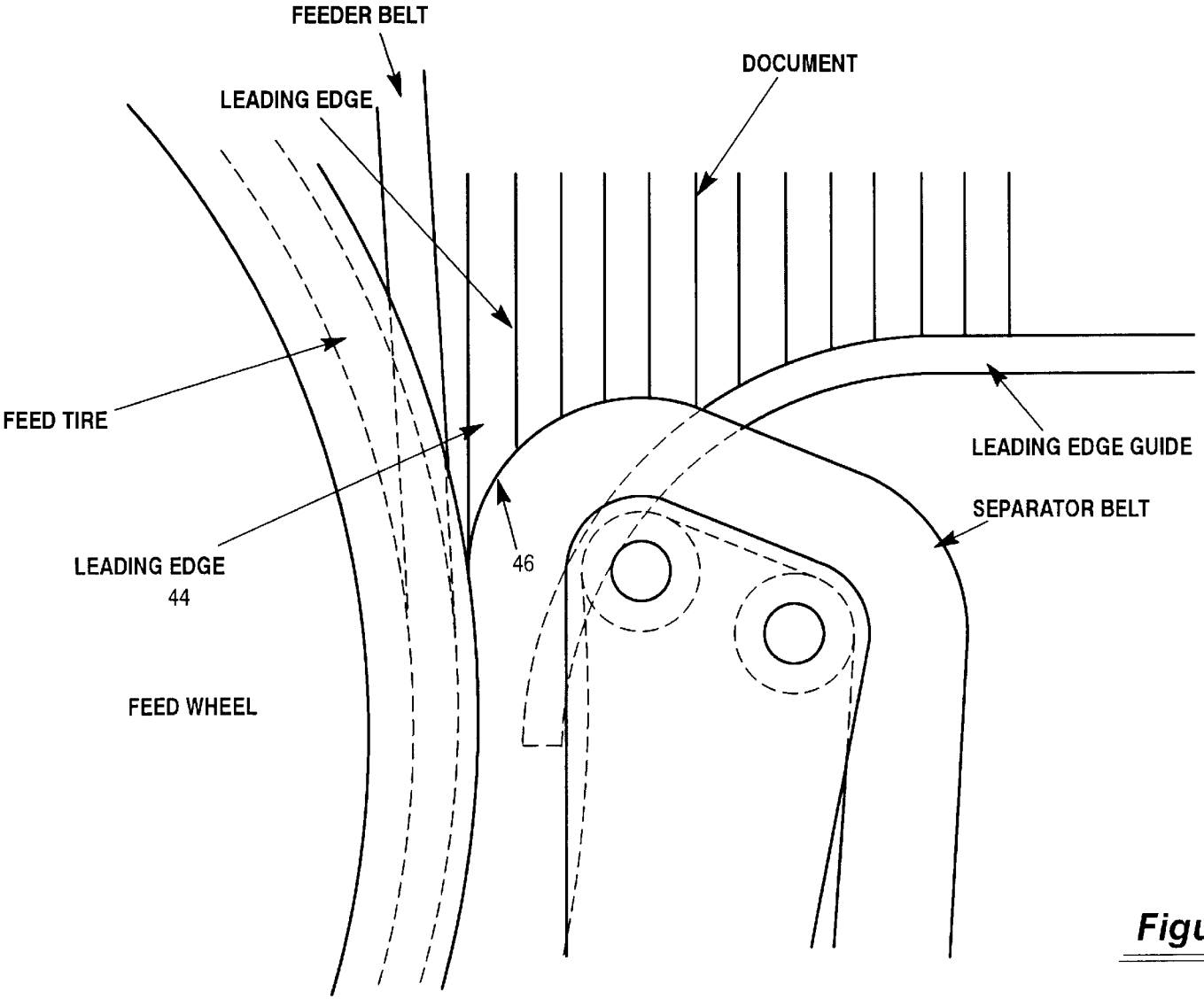
FIG. 3 is a side view of the feed wheel/separator nip showing the first document fed through the nip and successive documents in the stack approaching the feed wheel/separator nip.

FIG. 3 shows wedge of document leading edges 44, located to the right of first document 24. The wedge of document leading edges 44 is formed at the feed tire 20, separator belt 22 and leading edge guide 12. Leading edges 50 in wedge of document leading edges 44 have a velocity magnitude that is a function of document thickness, shape of the wedge and feed rate. The velocity of document leading edges 50, however, is much less than the velocity of first document 24, therefore first document 24 moves through the feeder/separator nip 28.

Figure 2:
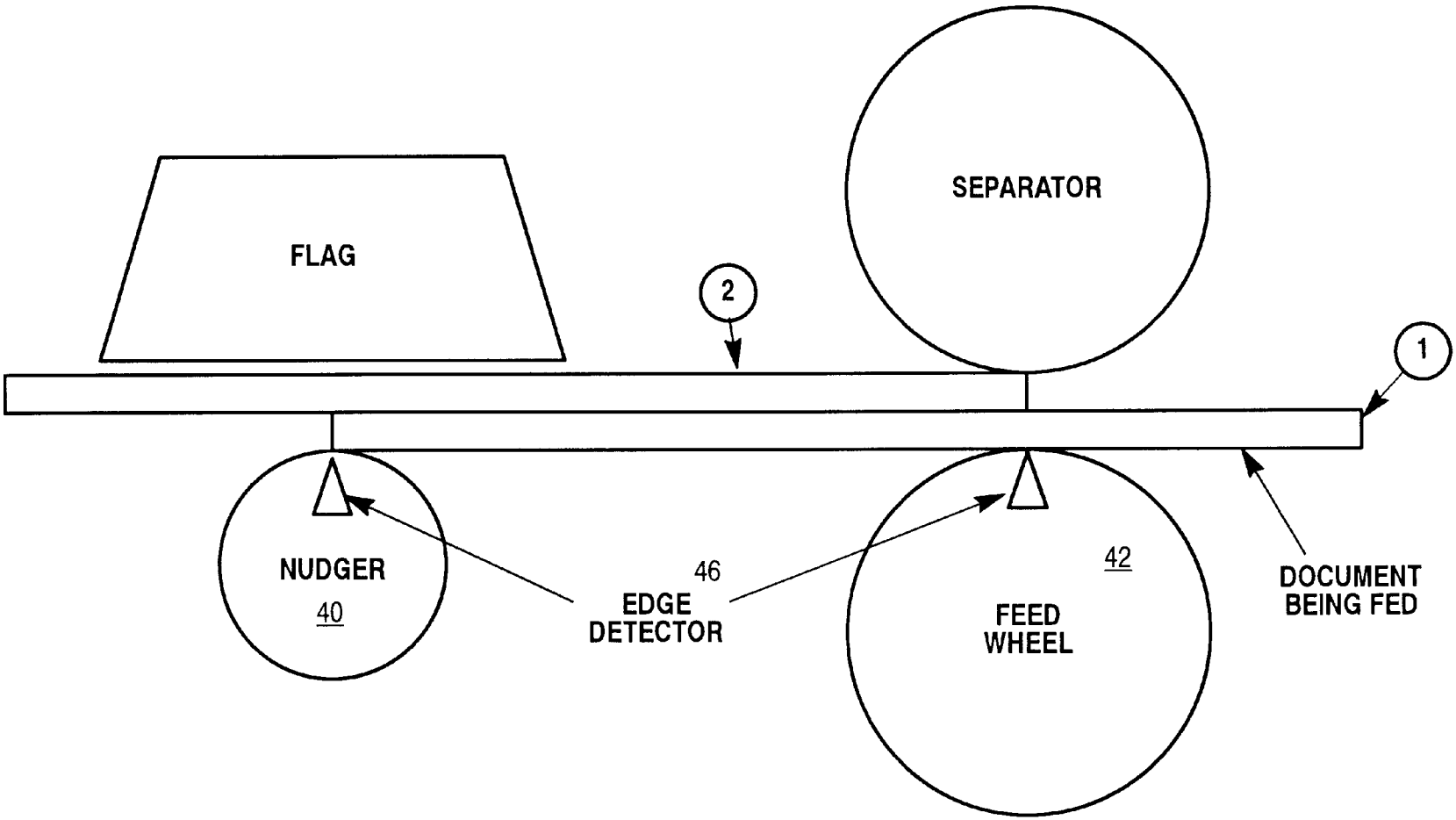
FIG. 2 is a perspective view showing edge detectors located near the nudger and the feed wheel/separator nip.

FIG. 2 provides a preferred embodiment of edge detectors 46. Document edge detectors can be either an optical, infrared, ultrasonic or another motion sensing device. In the preferred embodiment, edge detectors 46 include a nudger edge detector 40 located at nudger nip 48 and feed wheel/separator edge detector 42 located at feed wheel 32. Nudger edge detector 40 senses trailing edge 30 of first document 24. Nudger edge detector 40 sends a signal to independent motor 20 that drives nudger 18, and nudger 18 stops applying a force to next document 26 at the nudger nip 48. Nudger 18 is stopped from applying a force at nudger nip 48. Flag 14, however, continues to apply a force to document stack 16. At this time, nudger 18 is now contacting next document 26, thereby aiding separator 22 in preventing the feeding of next document 26.

Feed wheel/separator edge detector 42 senses trailing edge 30 of first document 24 which has cleared the path for next document 26 to travel to and through feeder/separator nip 28, and then sends a signal to independent motor 20 that drives nudger 18. Nudger 18 is turned on and nudger 18 applies a force to next document 26 at the nudger nip 48, furthering next document 26 towards feeder/separator nip 28.

What is claimed is:

1. A document feeder with overlap protection comprising:

a nudger positioned to rest on a first document of a document stack located in a hopper, for maintaining a proper space between a first document and a next document, said nudger independently controlled by a nudger edge detector located at said nudger indicating whether said nudger should be rotating;

a feed wheel for accelerating said first document; and a separator for retaining said next document in said hopper.

2. A document feeder with overlap protection of claim 1, wherein said nudger edge detector is adapted to sense whether a trailing edge of said first document is present.

3. A document feeder with overlap protection of claim 1, further comprising a feed wheel edge detector adapted to sense whether a trailing edge of said first document is present.

4. A document feeder with overlap protection of claim 1 further comprising independent motor providing power to said nudger.

5. A document feeder with overlap protection of claim 4, whereby said independent motor is responsive to said nudger edge detector.

6. A document feeder with overlap protection comprising:

a nudger positioned to rest against a first document of a document stack located in a hopper for maintaining a proper space between said first document and a next document;

an independent motor dedicated to the nudger for controlling speed of the nudger; and at least one edge detector located to detect an edge of said first document at the nudger and connected to said independent motor for signaling whether said nudger should be on or off.

7. A document feeder with overlap protection of claim 6, wherein said edge detector is connected to said independent motor, signaling whether a trailing edge of said first document is present.

8. A document feeder with overlap protection of claim 6, further comprising a feed wheel/separator edge detector, connected to said independent motor, signaling whether trailing edge of said first document is present.

9. A document feeder with overlap protection comprising:

a nudger positioned to rest against a first document of a document stack located in a hopper for maintaining a proper space between first document and a next document;

a feed wheel for accelerating said first document;

a independent motor for driving said nudger independently of said feed wheel; and a separator for retaining next document in said hopper further comprising at least one edge detector for signaling said nudger to turn off with at least one of said edge detectors located to detect a trailing edge of said first document as said first document moves within said hopper.

* * * * *